US006812408B2

(12) United States Patent
Clark et al.

(10) Patent No.: US 6,812,408 B2
(45) **Date of Patent: *Nov. 2, 2004**

(54) MULTI-PAIR DATA CABLE WITH CONFIGURABLE CORE FILLING AND PAIR SEPARATION

(75) Inventors: William Clark, Lancaster, MA (US); Joseph Dellagala, Shrewsbury, MA (US); Kenneth Consalvo, Leominster, MA (US)

(73) Assignee: Cable Design Technologies, Inc., Washington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/446,371

(22) Filed: May 28, 2003

(65) Prior Publication Data

US 2004/0035603 A1 Feb. 26, 2004

Related U.S. Application Data

(63) Continuation-in-part of application No. 10/336,535, filed on Jan. 3, 2003, which is a continuation of application No. 09/853,512, filed on May 11, 2001, now Pat. No. 6,570,095, which is a continuation of application No. 09/257,844, filed on Feb. 25, 1999, now Pat. No. 6,248,954.

(51) Int. Cl.[7] ..... H01B 7/00
(52) U.S. Cl. ..... 174/113 R; 174/113 C
(58) Field of Search ..... 174/110 R, 110 SR, 174/110 D, 110 FC, 110 F, 113 R, 113 AS, 113 C, 120 R, 120 SC, 121 R, 121 A, 121 AR, 120 AR

(56) References Cited

U.S. PATENT DOCUMENTS

| | | | | |
|---|---|---|---|---|
| 483,285 A | | 9/1892 | Guilleaums | |
| 1,883,269 A | | 10/1932 | Yonkers | |
| 1,976,847 A | * | 10/1934 | Gordon et al. | 174/112 |
| 2,538,019 A | | 1/1951 | Lee | |
| 3,328,510 A | | 6/1967 | White | |
| 3,622,683 A | * | 11/1971 | Roberts et al. | 174/36 |
| 3,649,744 A | | 3/1972 | Coleman | |
| 3,819,443 A | | 6/1974 | Simons et al. | |
| 3,881,052 A | * | 4/1975 | Britz et al. | 174/103 |
| 3,911,200 A | * | 10/1975 | Simons et al. | 174/36 |

(List continued on next page.)

FOREIGN PATENT DOCUMENTS

| | | |
|---|---|---|
| DE | 697378 C | 12/1940 |
| FR | 694100 A | 11/1930 |

OTHER PUBLICATIONS

C&M Corporation, the "Enginneering Design Guide," 3rd edition, p. 11.

*Primary Examiner*—William H. Mayo, III
(74) *Attorney, Agent, or Firm*—Lowrie, Lando & Anastasi, LLP

(57) ABSTRACT

An improved data telecommunications cable includes a plurality of twisted pairs of insulated conductors and at least one configurable tape separator disposed between the plurality of twisted pairs of insulated conductors along a longitudinal length of the cable. The communications cable also includes a jacket assembly enclosing the plurality of twisted pairs of insulated conductors and the configurable tape separator. The configurable tape separator separates at least one of the plurality of twisted pairs of insulated conductors from others of the plurality of twisted pairs of insulated conductors with a spacing sufficient to provide a desired crosstalk isolation between each of the plurality of twisted pairs of insulated conductors. The configurable tape separator may include a dielectric tape and one or more conductive or partially conductive layers.

51 Claims, 10 Drawing Sheets

U.S. PATENT DOCUMENTS 4,034,148 A 7/1977 Lang
4,319,940 A 3/1982 Arroyo et al.
4,487,992 A 12/1984 Tomita
4,500,748 A 2/1985 Klein
4,595,793 A 6/1986 Arroyo et al.
4,605,818 A 8/1986 Arroyo et al.
4,647,714 A * 3/1987 Goto ..... 174/36
4,697,051 A 9/1987 Beggs et al.
4,767,891 A 8/1988 Biegon et al.
4,777,325 A 10/1988 Siwinski
4,788,088 A * 11/1988 Kohl ..... 428/34.5
4,800,236 A * 1/1989 Lemke ..... 174/36
4,912,283 A 3/1990 O'Connor
5,037,999 A * 8/1991 VanDeusen ..... 174/36
5,132,488 A 7/1992 Tessier et al.
5,173,961 A * 12/1992 Chiasson ..... 385/113
5,253,317 A 10/1993 Allen et al.
5,298,680 A 3/1994 Kenny
5,393,933 A 2/1995 Goertz
5,399,813 A 3/1995 McNeill et al.
5,424,491 A 6/1995 Walling
5,493,071 A 2/1996 Newmoyer
5,514,837 A 5/1996 Kenny et al.
5,789,711 A 8/1998 Gaeris et al.
5,952,615 A 9/1999 Prudhon
5,969,295 A 10/1999 Boucino et al.
6,037,546 A 3/2000 Mottine et al.
6,194,663 B1 2/2001 Friesen et al.
6,248,954 B1 6/2001 Clark et al.
6,255,593 B1 7/2001 Reede
6,288,340 B1 * 9/2001 Arnould ..... 174/113 R
6,300,573 B1 10/2001 Horie et al.
6,462,268 B1 * 10/2002 Hazy et al. ..... 174/36
6,570,095 B2 5/2003 Clark et al.

* cited by examiner

MULTI-PAIR DATA CABLE WITH CONFIGURABLE CORE FILLING AND PAIR SEPARATION

CROSS-REFERENCE TO RELATED APPLICATIONS

This application is a Continuation-in-Part of and claims priority under 35 U.S.C. §120 to commonly-owned, co-pending U.S. patent application Ser. No. 10/336,535, Jan. 3, 2003, entitled "Multi-Pair Data Cable with Configurable Core Filling and Pair Separation" (now pending) which is a Continuation of and claims priority under 35 U.S.C. §120 to commonly-owned, U.S. patent application Ser. No. 09/853,512, filed May 11, 2001, now U.S. Pat. No. 6,570,095, issued May 27, 2003, entitled "Multi-Pair Data Cable with Configurable Core Filling and Pair Separation" which is a continuation of and claims priority under 35 U.S.C. §120 to commonly-owned, U.S. patent application Ser. No. 09/257,844, now U.S. Pat. No. 6,248,954 B1, entitled "Multi-Pair Data Cable with Configurable Core Filling and Pair Separation," filed Feb. 25, 1999, which is hereby incorporated by reference in its entirety.

BACKGROUND

1. Field of the Invention

The present invention relates to high-speed data communications cables using at least two twisted pairs of insulated conductors. More particularly, the invention relates to high-speed data communications cables having a light-weight, configurable core-filling isolation tape separator that provides geometrical separation between the twisted pairs of insulated conductors.

2. Discussion of the Related Art

High-speed data communications media typically include pairs of insulated conductors twisted together to form a balanced transmission line. Such pairs of insulated conductors are referred to herein as "twisted pairs." When twisted pairs are closely placed, such as in a cable, electrical energy may be transferred from one twisted pair of a cable to another twisted pair. Such energy transferred between twisted pairs is referred to as crosstalk. As operating frequencies increase, improved crosstalk isolation between the twisted pairs becomes more critical.

The Telecommunications Industry Association and the Electronics Industry Association (TIA/EIA) have developed standards which specify specific categories of performance for cable impedance, attenuation, skew and particularly crosstalk isolation. One standard for crosstalk or, in particular, crosstalk isolation, is TIA/EIA-568-A, wherein a category 5 cable is required to have 38 dB of isolation between the twisted pairs at 100 MHz and a category 6 cable is required to have 42 dB of isolation between the twisted pairs at 100 MHz. Various cable design techniques have been used in order to try to reduce crosstalk and to attempt to meet the industry standards.

For example, one cable implementation known in the industry that has been manufactured and sold as a high-speed data communications cable, includes the twisted pairs formed with relatively tight twists, and the cable is formed into a round construction. In this conventional cable, each twisted pair has a specified distance between twists along a longitudinal direction of the twisted pair, that distance being referred to as the "twist lay." When adjacent twisted pairs have the same twist lay and/or twist direction, they tend to lie within a cable more closely spaced than when the twisted pairs have different twist lays and/or a different twist direction. Such close spacing increases the amount of undesirable crosstalk which occurs between the twisted pairs. In some conventional cables, each twisted pair within the cable has a unique twist lay in order to increase the spacing between pairs and thereby to reduce the crosstalk between twisted pairs of the cable. In addition, the twist direction of the twisted pairs may also be varied. However, this industry standard configuration can only achieve limited crosstalk isolation.

Another cable implementation 100 disclosed in U.S. Pat. No. 4,777,325, is illustrated in FIG. 1, wherein the twisted pairs are enclosed within a jacket 102 that has a wide, flat configuration. In particular, a plurality of twisted pairs 104*a*–104*b*, 106*a*–106*b*, 108*a*–108*b*, and 110*a*–110*b* are positioned side-by-side, each in separate compartments 112, 114, 116, and 118 formed within a flat hollow envelope of an extruded outer sheath 120. The cable is provided with separator ribs 122 between a top and a bottom of the sheath to divide the outer sheath into the separate compartments and to prevent lateral movement of the twisted pairs out of their respective compartments. However, one problem with this flat configuration for a cable is that it has limited flexibility as compared to that of a round cable, which hinders installation of the cable in conduits and around bends.

Another cable implementation 123which addresses the problem of twisted pairs lying too closely together within the cable is described, for example, in U.S. Pat. No. 5,789,711 and is illustrated in FIG. 2. In particular, the cable includes, for example, four twisted pairs 124 disposed about a central pre-shaped support 126, wherein the support positions a twisted pair within grooves or channels 128 formed by the support. In particular, the support provides the grooves or channels which keep the twisted pairs at fixed positions with respect to each other. The support can have any of a number of shapes, including, for example, a standard "X", a "+", or the separator as is illustrated in FIG. 2. The prongs or protrusions 130 of the support preserve the geometry of the pairs relative to each other, which helps reduce and stabilize crosstalk between the twisted pairs. However, some problems with the support is that the support adds cost to the cable, may limit the flexibility of the cable and increases the size; e.g., the diameter, of the cable. Another problem may be that the material which forms the support may result in the overall cable being a potential fire and/or smoke hazard.

Still another known industry cable implementation 132 is illustrated in FIG. 3. The cable utilizes a jacket 134 with inward protrusions 136 that form channels 138 within the cable. A twisted pair 140 of conductors 142, 144 is disposed within each channel. The protrusions are used to provide adequate pair separation. However, one problem with these protrusions is that they can be difficult to manufacture. In addition, the protrusions may not provide adequate separation between the twisted pairs where the stability of the protrusions is difficult to provide, and thus performance repeatability of the cable is an issue. Further, another problem is that the jacket is not easily strippable. When the cable is to be stripped by removing the outer jacket, which is often done with a sharp device such as, for example, a razor, the protrusions will not be cut by the incision around the circumference of the jacket and will have to be broken off separately in order to remove the jacket.

Accordingly, some of the problems with the above known configurations are that they are expensive, difficult to use, are generally undesirably large, and have decreased flexibility of the cables and workability of the twisted pairs of wires.

SUMMARY OF THE INVENTION

Therefore, a need exists for a high-speed data cable having multiple twisted pair wires with desired crosstalk performance, improved handling and termination capabilities, that is inexpensive, flexible and has a desired size. This invention provides an improved data cable.

According to the invention, a data communications cable has been developed so as to better facilitate the cable for its the intended use of high speed data transmission, yet maintain a form factor that has desired flexibility and workability, and that is compatible with industry standard hardware, such as plugs and jacks. The data communications cable of the invention has the additional benefit of a reduced cabled size relative to other known cables within its performance class.

In particular, the present invention provides these advantages by utilizing a configurable, highly flexible, tape separator to provide twisted pair separation for the cable.

One embodiment of a data communications cable of the invention includes a plurality of twisted pairs of insulated conductors including a first twisted pair of insulated conductors and a second twisted pair of insulated conductor, and a configurable tape separator disposed between the plurality of twisted pairs of insulated conductors and arranged so as to provide a channel within which the first twisted pair of insulated conductors is disposed such that the configurable tape separator separates the first twisted pair of insulated conductors from the second twisted pair of insulated conductors. The data communications cable further comprises a jacket enclosing the plurality of twisted pairs of insulated conductors and the configurable tape separator. In one example, the configurable tape separator may include a dielectric tape and a first conductive or semi-conductive layer disposed on a first side of the dielectric tape. In another example, the configurable tape separator may further comprise a second conductive or semi-conductive layer disposed on a second side of the dielectric tape. In some examples, the configurable tape separator may be substantially flat.

According to another embodiment, a communications cable comprises a plurality of twisted pairs of insulated conductors including a first twisted pair and a second twisted pair, a plurality of configurable tape separators disposed between the plurality of twisted pairs of insulated conductors so as to separate the first twisted pair from the second twisted pair, and a jacket surrounding the plurality of twisted pairs of insulated conductors and the plurality of configurable tape separators.

With these arrangements, data communications cables can be made with desired crosstalk isolation between the twisted pairs of insulated conductors. In addition, due to the conforming nature and the desired thickness of the configurable tape separator(s), the cable has desired flexibility, workability and size. Moreover, these advantages do not come at the expense of other properties of the cable such as, for example, size or reduced impedance stability. The configurable tape separator also facilitates termination of the data communications cable to known industry standard hardware.

BRIEF DESCRIPTION OF THE DRAWINGS

The objects, features and advantages of the present invention will become more apparent in view of the following detailed description of the invention when taken in conjunction with the figures, in which.

DETAILED DESCRIPTION

A number of embodiments of a data communications cable according to the invention will now be described in which the cable is constructed with a plurality of twisted pairs of insulated conductors and a core including one or more configurable, tape separators. However, it is to be appreciated that the invention is not limited to any number of twisted pairs or any profile for the configurable, tape separators illustrated in any of these embodiments. The inventive principles can be applied to cables including greater or fewer numbers of twisted pairs and having different profiles of the configurable tape separators. In addition, although these embodiments of the invention are described and illustrated in connection with twisted pair data communication media, it is to be appreciated that other high-speed data communication media can be used instead of twisted pairs of conductors in the constructions of the cable according to the invention, such as, for example, fiber optic media.

Figure 4:
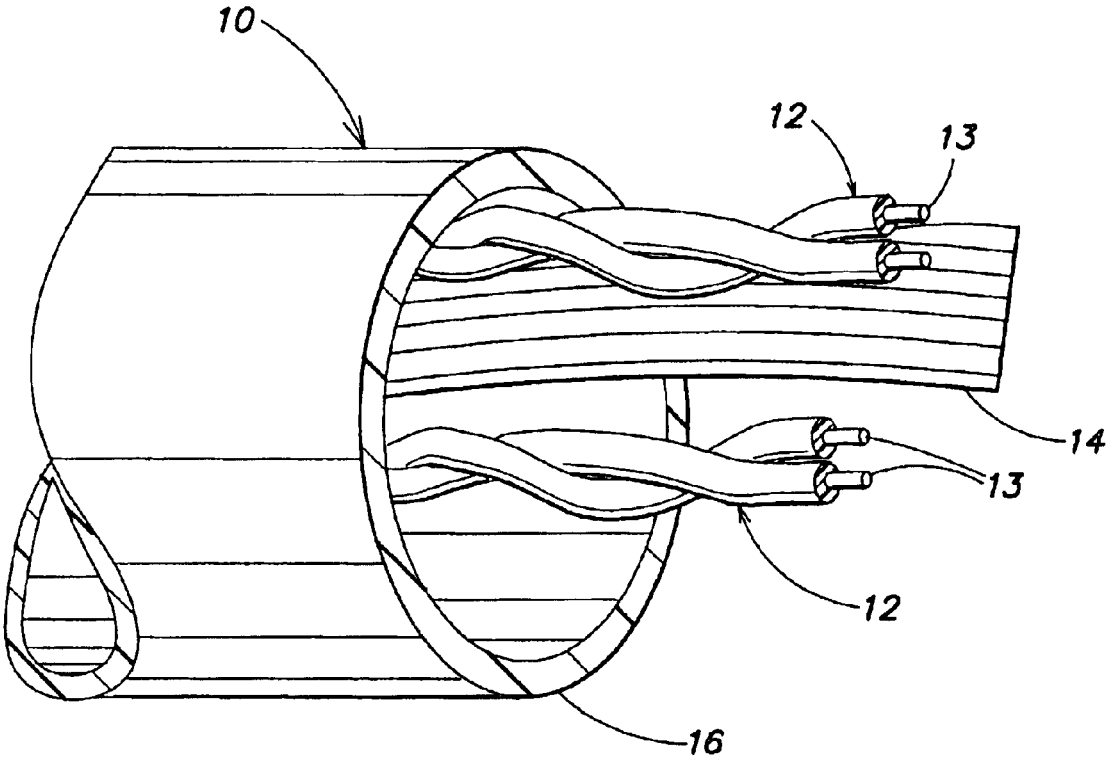
FIG. 4 is a perspective view of a data communications cable according to one embodiment of the invention.

FIG. 4 illustrates an embodiment of a data communications cable 10 according to the present invention. The cable 10 includes two twisted pairs 12 of insulated conductors 13.

The twisted pairs 12 are separated by a low dielectric constant, low dissipation factor, polymer configurable tape separator 14. The twisted pairs 12 and the configurable tape separator 14 are encased within a jacket assembly 16. The outer jacket can be a PVC, a low-smoke, low-flame PVC, or any plenum or non-plenum rated thermoplastic or any other jacket material known to those of skill in the art. In addition, the cable may be provided with a ripcord (not illustrated) located below the cable jacket to facilitate removal of the jacket from the cable.

Figure 5:
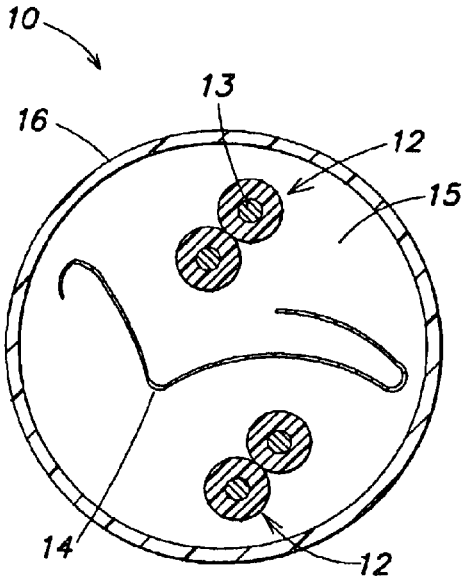
FIG. 5 is a cross-sectional view of another embodiment of a data communications cable according to the invention.

Referring to FIG. 5, there is illustrated a cross-sectional view of another embodiment of a cable. The configurable tape separator 14 runs along a longitudinal length of the cable, and is configured such that the twisted pairs are disposed within channels or grooves 15 formed by folding or arranging the tape separator along the length of the cable. As illustrated, the grooves 15 do not form completely enclosed channels. It is to be appreciated that the terms "grooves" and "channels" are used synonymously throughout this disclosure. Some of the advantages of this cable according to the invention are that the tape separator provides structural stability during manufacture and use of the data communications cable, yet does not degrade the flexibility and workability of the cable, and does not substantially increase the size of the cable. In addition, the tape separator improves the crosstalk isolation between the twisted pairs by providing desired spacing between the twisted pairs. Therefore, the configurable tape separator of the invention lessens the need for complex and hard to control twist lay procedures, core filling arrangements and jacket embodiments described above with respect to the related art.

The above-described embodiments of the data communications cable can be constructed using a number of different materials as the tape separator 14. For example, the configurable tape separator may comprise fluorinated ethylene propylene (FEP), a polyolefin or a foamed polyolefin. While the invention is not limited to the materials described herein, the invention is advantageously practiced using these materials. In particular, the configurable tape separator is preferably a flame-retardant, low-dielectric constant, low-dissipation factor, foamed polymer tape, such as, for example, a foamed flame retardant, cellular polyolefin or fluoropolymer like NEPTC PP500 "SuperBulk," a foamed FEP or a foamed polyvinyl chloride (PVC). Non-flame retardant versions of the above-described tape separators may be used in a non-plenum rated application where the cable is not required to pass industry standard flame and smoke tests such as the Underwriters Laboratories (UL) 910 test. Another preferable configurable tape separator is a woven fiberglass tape normally used as a binder for cables, such as, for example, Allied Fluoroglass CTX3X50. This woven fiberglass binder is preferably used in a plenum rated application where the cable must satisfy the UL 910 test.

Figure 16A:
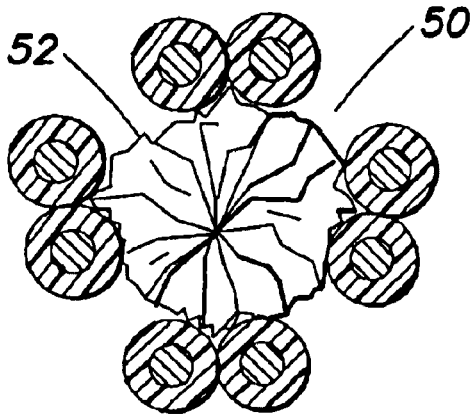
FIG. 16A illustrates a core of a four twisted pair cable.
Figure 16B:
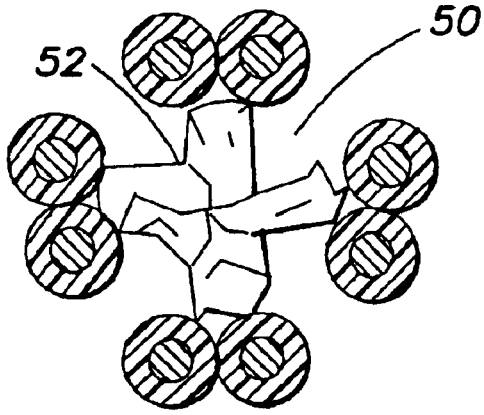
FIG. 16B is an exploded view of the core of the cable of FIG. 15A, having a filler material according to the invention.

Still another tape separator material that may be used in the cable of the invention is a bulk filling material such as a polyolefin or glass fiber filler that is flame-retardant and is typically shredded or fibrillated, but may also be solid, such as, for example, Chadwick AFT 033 Fiberglass. Such a bulk filling material is typically twisted up and used as a filling material in a core of the cable, with no other purpose. In particular, referring to FIG. 16A, the bulk filler is typically used as a core filling material that fills 100% of the core area 50 between the illustrated four twisted pair, that is used to keep the cable in a more or less round construction. However, referring to FIG. 16B, according to the present invention it is preferable to provide less than 100% of the core area 50 with the filling material; and it is more preferable us use less than 42% of the core with the filler material 52 for providing isolation between the twisted pairs. In a preferred embodiment, approximately 32% of the overall core area between the four twisted pairs of the cable is filled with such a filler and shaped as described herein. Therefore, one aspect of the present invention is the recognition that the filler or tape described above can be used to prevent physical contact between opposite and adjacent twisted pairs, thereby increasing the isolation between the twisted pairs, while not requiring the entire core area be filled, and therefore not sacrificing the size, cost or flexibility of the overall cable.

Figure 6:
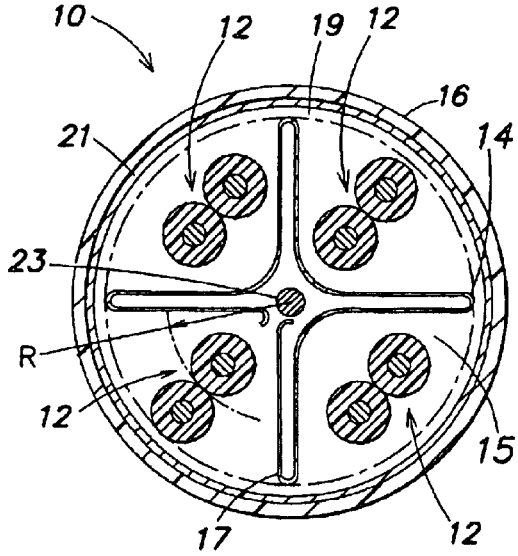
FIG. 6 is a cross-sectional view of a data communications cable according to another embodiment of the invention.

Referring to FIG. 6, there is illustrated a cross-sectional view of another embodiment of the data cable 10 of the invention. The cable includes the low-dielectric constant, low-dissipation factor polymer tape separator 14 formed into a cable core in such a way as to physically separate the four twisted pairs 12, thereby decreasing field coupling between the twisted pairs, providing a desired opposite twisted pair-to-pair physical distance, as well as providing a desired adjacent pair separation. It is to be appreciated that like components of the data communications cable illustrated in FIGS. 4–5 have been provided with like reference numbers and the description of these components applies with respect to each of the cable embodiments to be described herein.

In the embodiment of the cable illustrated in FIG. 6, the tape separator 14 is a flat configurable tape used as a core filler, that is shaped to have the illustrated profile and that is provided in the cable between the four twisted pairs 12. In particular, in this embodiment, the configured tape separator has a shape somewhat like a "+", providing four channels 15 between each pair of protrusions 17 formed by the tape separator. Each channel carries one twisted pair 12 that is placed within the channel during a process of manufacturing the cable that will be described in further detail below. As is discussed above, the illustrated configurable core profile should not be considered limiting. In particular, although it is preferred that the tape separator is supplied as a flat extruded tape, the configurable tape separator may be made by a process other than extrusion and may have a number of different shapes or provide a number of different channels, as is illustrated by some of the embodiments described in further detail below.

Referring again to FIG. 6, the data communications cable may also be provided with a binder 19, as illustrated in phantom, that is wrapped around the configurable tape separator 14 and the plurality of twisted pairs 12. For this embodiment, it may be preferable that the configurable tape separator be conductive or semi-conductive (partially conductive). For example, the configurable tape separator may include an aluminum/mylar (or other polyester) tape, with an aluminum layer on one or both sides of the mylar (or other dielectric material) tape. In one embodiment, the configurable tape separator 14 includes an aluminum layer on the side of the tape facing the plurality of twisted pairs. In this embodiment, it may be preferred that the binder also be made of the aluminum/mylar tape, with the aluminum layer of the tape facing the plurality of the twisted pairs so that the combination of the binder and the configurable tape separator provide four electrically shielded, enclosed channels. With this embodiment, the four enclosed channels are isolated from one another to provide desired crosstalk isolation. In addition, another benefit of the embodiment of the cable is that a cable adjacent this cable will have reduced coupling with the cable of the invention, or in other words, reduced alien cross talk, as it is known in the industry.

In another embodiment of the cable, the configurable tape separator may include multiple layers, such as, for example, a dielectric tape layer with a metal (e.g. aluminum) layer disposed on one side of the tape. In one example, the configurable tape separator may be arranged within the cable such that the metal layer is on the side of the tape facing away from the twisted pairs. In this configuration, the configurable tape separator 14 may be used to provide shielded channels within which the twisted pairs are disposed so as to shield the twisted pairs from one another by providing a shielded core that shields each twisted pair from another via the core. In addition, the cable may be provided with an overall shield or binder that can be disposed around the twisted pairs and the core, and that may shield the twisted pairs from alien crosstalk (i.e., signals coming from outside the cable).

Figure 7A:
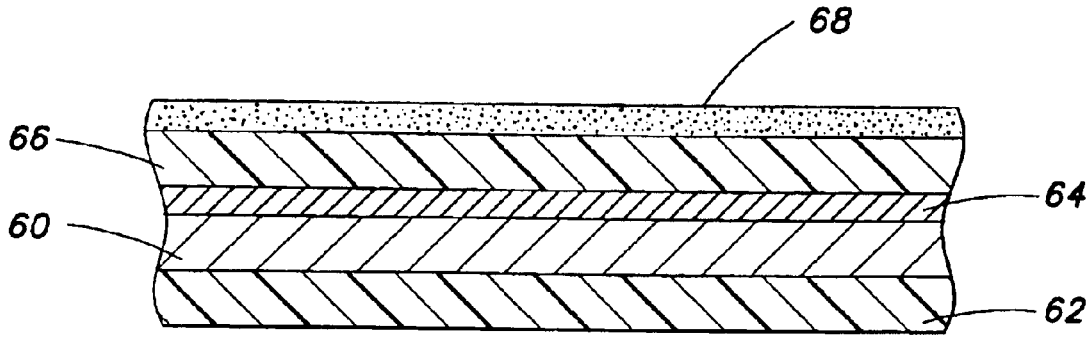
FIG. 7A is a cross-sectional view of one embodiment of a multi-layer configurable tape separator according to the invention, illustrated with exaggerated thickness.
Figure 7B:
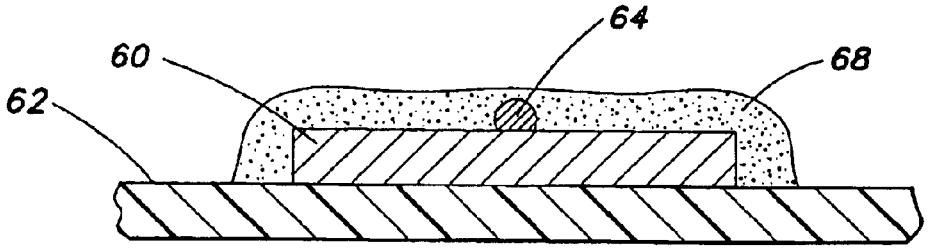
FIG. 7B is a cross-sectional view of another embodiment of a multi-layer configurable tape separator according to the invention, illustrated with exaggerated thickness and width.

Alternatively, the configurable tape separator may include more than two layers. For example, the configurable tape separator may have a "tri-laminate" structure including a dielectric tape with a metal (e.g. aluminum) layer disposed on both sides of the tape. Multiple layer configurable tape separators may also include layers formed of other materials, such as pressure sensitive adhesives, semi-conductive materials (for example, a ferrite loaded (filled) polymer), integral flat or round drain or ground wires to facilitate shield grounding, etc. For example, referring to FIG. 7A, there is illustrated a four layer configurable tape separator that comprises an inner layer of aluminum 60, a polyolefin layer 62 disposed on a first side of the aluminum layer 60, a flat or round metal drain or ground wire 64 (hereinafter generically referred to as drain wire 64) disposed on a second side of the aluminum layer and a second polyolefin layer 66 disposed over the drain wire 64. The configurable tape separator may further comprise a pressure sensitive adhesive coating 68 disposed, for example, over the second polyolefin layer 66, thereby providing a four layer configurable tape separator. In one example, one or more of the polyolefin layers or the pressure sensitive adhesive layer 68 may be wider than, or extend over, the aluminum layer, and/or the drain wire, so as to provide substantially complete electrical isolation of one or both of the metal layers, for example, as shown in FIG. 7B. Of course it is to be appreciated that the multiple-layer configurable tape separators of the invention are not limited to comprising two, three or four layers and may comprise additional layers. Furthermore, it is to be appreciated that the layers of the multiple-layer configurable tape separators may be formed of many different materials and are not limited to the specific examples provided herein. For example, the aluminum layer of the four-layer configurable tape separator described above may be replaced with another metal layer and is not required to be aluminum, and the polyolefin layers may instead be of another dielectric material. It is also to be understood that any of the configurable tape separator tape structures described above may be used in combination with a binder in the cable, as described in reference to FIG. 6. Bi-laminate and tri-laminate tape materials may be obtained from, for example, manufacturers such as Neptco, Fascile, Chase and Sons, and Ensign-Bickford.

The embodiment of FIG. 6 further illustrates that a shield 21 may also be laterally wrapped around the binder 19; the shield is preferably made from a foil or metal, but may also be a semi-conductive (partially conductive) material. The shield may be applied over the cable before jacketing the cable with the jacket 16, and is also used to help reduce crosstalk between the twisted pairs, to reduce alien crosstalk, and prevent the cable from causing or receiving electromagnetic interference. It is to be appreciated that the shield can also be provided in lieu of the binder. In particular, greater crosstalk isolation between the twisted pairs of the cable, and reduced alien crosstalk may also be achieved by using a conductive shield 21 that is, for example, a metal braid, a solid metal foil, or a conductive plastic that is in contact with ends of the protrusions 17 of the configurable filler 14. If the configurable tape separator is also conductive or semi-conductive as described above for the aluminum/mylar tape, then the combination of the tape separator and the shield forms conductive compartments that shield each twisted pair from the other twisted pairs.

Referring again to FIG. 6, the cable can advantageously include a metal drain wire 23 exposed, for example, within the middle of the configurable tape separator 14. The metal drain wire may be flat or round and runs the length of the cable and acts as a ground. However, it is to be appreciated that the metal drain wire need not be so placed and may also be arranged in arrangements known to those of skill in the art such as, for example, spirally wrapped around the binder 19 or the shield 21.

It is preferable in at least some of the embodiments described herein that the protrusions 17 of the configurable tape separator extend at least beyond a center axis of each twisted pair, known in the art as a pitch radius. The pitch radius is illustrated in FIG. 6 as the radius R between the center of the cable core and the center axis of the twisted pairs 12 of conductors. This preferred configuration of the configurable tape separator ensures that the twisted pairs do not escape their respective spaces or channels. It is also to be appreciated that the process of jacketing of the cable, to be described in detail below, may bend the ends of the protrusions 17 over slightly (not illustrated), since the configurable tape separator is relatively formable.

Figure 8:
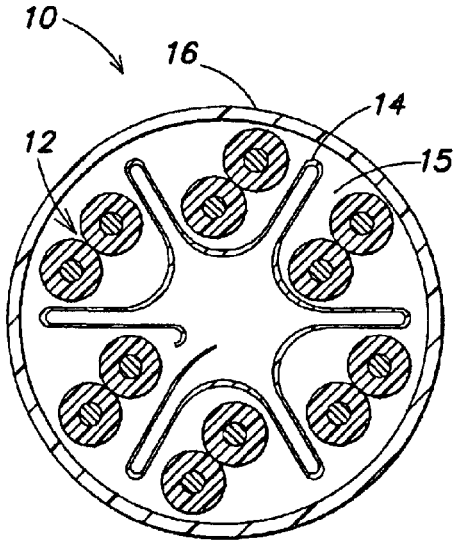
FIG. 8 is a cross-sectional view of a data communications cable according to another embodiment of the invention.

As discussed above, it is to be appreciated that the twisted pairs of insulated conductors and configurable tape separator of the communications data cable of the invention, can be configured in a variety of ways. FIGS. 8–13 depict cross-sectional views of various embodiments of the data communications cable of the invention. As illustrated, for example, in FIGS. 8, 10 and 12, the configurable tape separator may be configured such that the grooves 15 do not form completely enclosed channels. FIG. 8 depicts a cable 10 wherein six twisted pairs 12 are encased within the jacket assembly 16, and are separated from each other by the configurable tape separator 14. The tape separator 14 is configured in a somewhat "*" shape that provides support and placement of the twisted pairs so that the twisted pairs 12 have a desired spatial arrangement and do not come into direct physical contact with each other.

Figure 9:
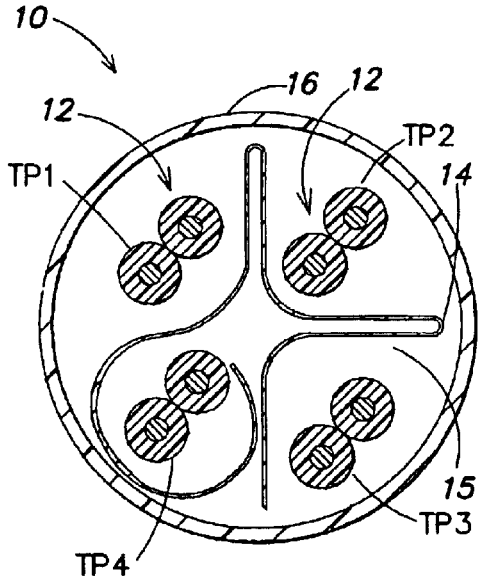
FIG. 9 is a cross-sectional view of a data communications cable according to another embodiment of the invention.

FIG. 9 depicts still another embodiment of the data communications cable 10 having multiple twisted pairs 12 encased within the jacket assembly 16 and having at least one of the twisted pairs isolated by the tape separator 14, from the remainder of the twisted pairs. In particular, referring to FIG. 9, the twisted pairs have been labeled TP1, TP2, TP3 and TP4, wherein twisted pair TP4 is isolated from twisted pairs TP1, TP2 and TP3 by the tape separator 14. It is an advantage of this embodiment, that the tape separator 14 can be provided with an appropriate number of twists or wrappings around the twisted pair TP4, so as to provide selective isolation between twisted pair TP4 and twisted pairs TP1, TP2 and TP3. This embodiment of the cable according to the invention can be used, for example, to provide better isolation between a weakest one or a weakest combination of twisted pairs of cables, in an environment where there is known to be a low amount of isolation between a particular twisted pair and another twisted pair, or a plurality of twisted pairs. Accordingly, with this embodiment of the cable of the invention, there can be selective enhancement of isolation between twisted pairs TP1–TP4, TP2–TP4, and TP3–TP4. It is to be appreciated that although the twisted pair TP4 has been illustrated as being isolated from the remainder of the twisted pairs, that any of the twisted pairs can be so wrapped with the filler and isolated. This embodiment of the invention may also be used in conjunction with a lessening of the twist lays requirements for the twisted pairs, to provide cable having a same amount of isolation between twisted pairs as a cable with tighter twist lays. Accordingly, this embodiment of the cable according to the invention allows for selective design of isolation between particular twisted pairs of the cable and lessening of the twist lay requirements for the cable.

Figure 10:
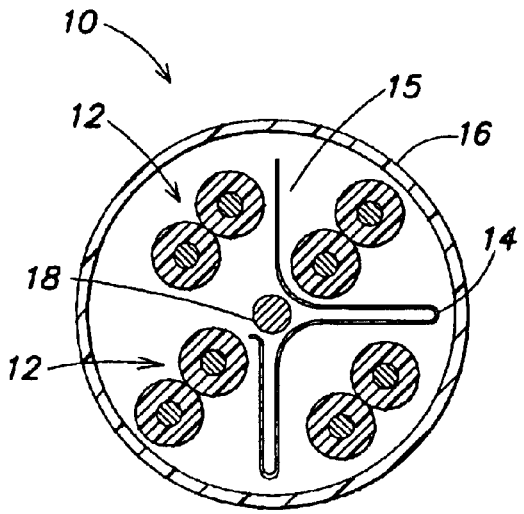
FIG. 10 is a cross-sectional view of a data communications cable according to another embodiment of the invention.

FIG. 10 depicts still another embodiment of the data communications cable 10 having multiple twisted pairs 12 encased within the jacket assembly 16 and physically separated from each other by the configurable tape separator 14, and also including a central core filler 18 positioned at the middle of the cable and that runs along the longitudinal length of the cable, provided less than 100% of the core is filled with the filler. The configurable tape separator provides desired separation between the individual twisted pairs 12 as discussed above. The central core 18 provides additional support or structure and may be formed of, for example, a solid or foamed flame retardant polyolefin or other materials that are known in the industry. For plenum rated cables, it is preferable that the core be any of one or more of the following compounds: a solid low-dielectric constant fluoropolymer, e.g. ethylene chlorotrifluoroethylene (E-CTFE), FEP, a foamed fluoropolymer, e.g. foamed FEP, and PVC in either solid, low dielectric constant form or foamed. The central core filling 18 may also be constructed of the same materials as the configurable tape separator 14 discussed above.

In another embodiment, the data cable of the invention may include two or more configurable tape separators having the characteristics described above. For example, referring to FIG. 11, the data cable may include two configurable tape separators 14, 14*a* that may be arranged so as to separate the twisted pairs from one another. In the illustrated example, the configurable tape separators may be arranged to separate, for example, twisted pairs TP1 and TP2, and a central core filling member 18 may also be included in the cable, for example, to provide separation between twisted pairs TP3 and TP4. It is to be appreciated that according to the invention, two or more configurable tape separators may be used in combination to produce any number of configurations, such as the "+" or "*" shaped profiles, illustrated in FIGS. 6–10. For example, referring to FIG. 12, there is illustrated one embodiment of the invention comprising four configurable tape separators 14*a–d* arranged to construct an overall approximately "+" shaped core, which is an alternative to the structure illustrated in FIG. 6 that was formed by folding a single configurable tape separator. The core provides four channels 15, each channel comprising one twisted pair 12 that is placed within the channel 15 during a process of manufacturing the cable. Of course it is to be appreciated that the invention is not limited to the particular embodiments illustrated, and any number of configurable tape separators may be used to provide many different configurations within a cable to achieve reduced crosstalk between all or selected twisted pairs within the cable. For example, depending upon the thickness of the configurable tape separator and/or the number of layers of the configurable tape separator (e.g., resulting from folding or arranging of the configurable tape separator) positioned between any given two twisted pairs, approximately 3 to 15 dB of crosstalk isolation may be achieved between the twisted pairs. Additionally, depending on the configuration of the configurable tape separator within the cable, oppositely located twisted pairs may have an added advantage of increased separation resulting from positioning of the configurable tape separator between them.

Figure 1:
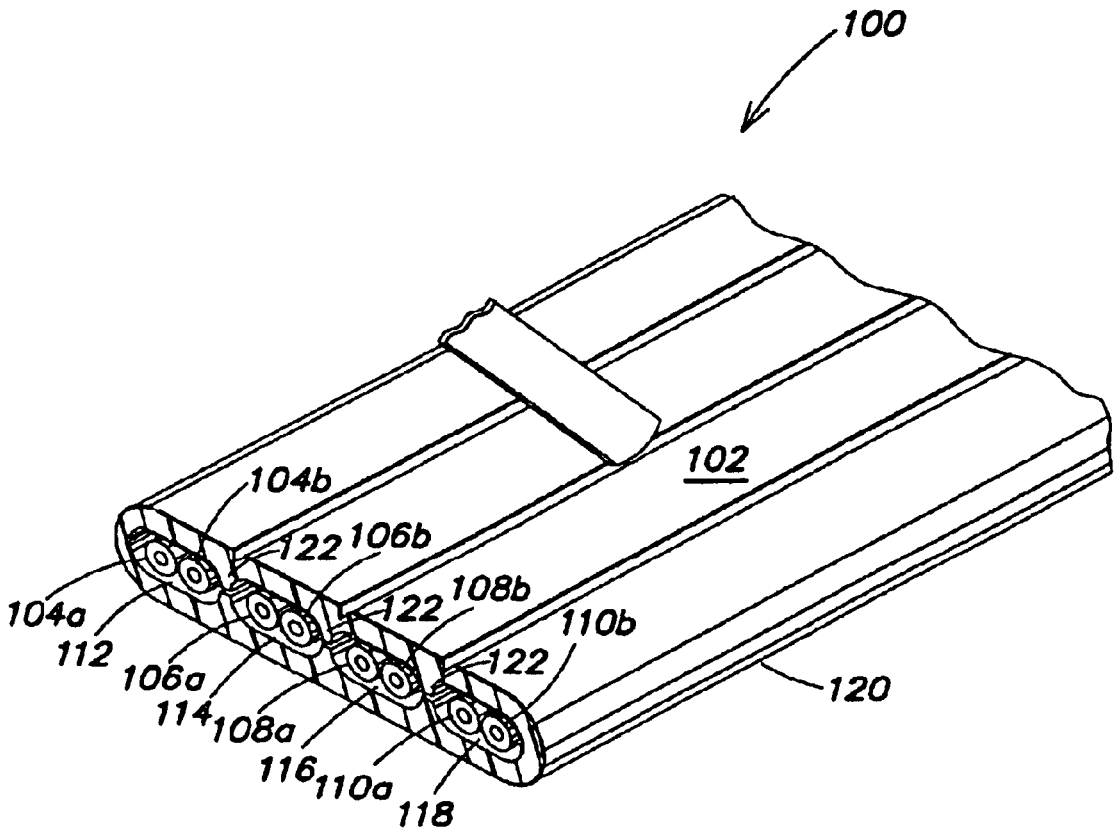
FIG. 1 (RELATED ART)
FIG. 1 is a perspective view of an embodiment of a communications cable according to the related art.
Figure 2:
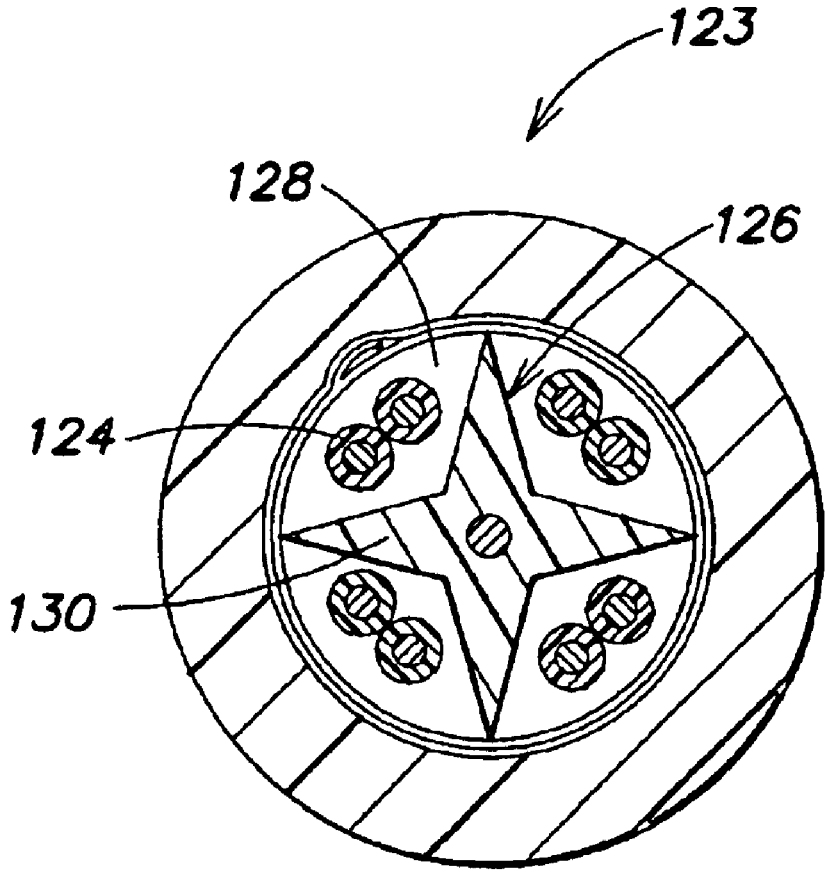
FIG. 2 (RELATED ART)
FIG. 2 is a cross-sectional view of another embodiment of a communications cable according to the related art.
Figure 3:
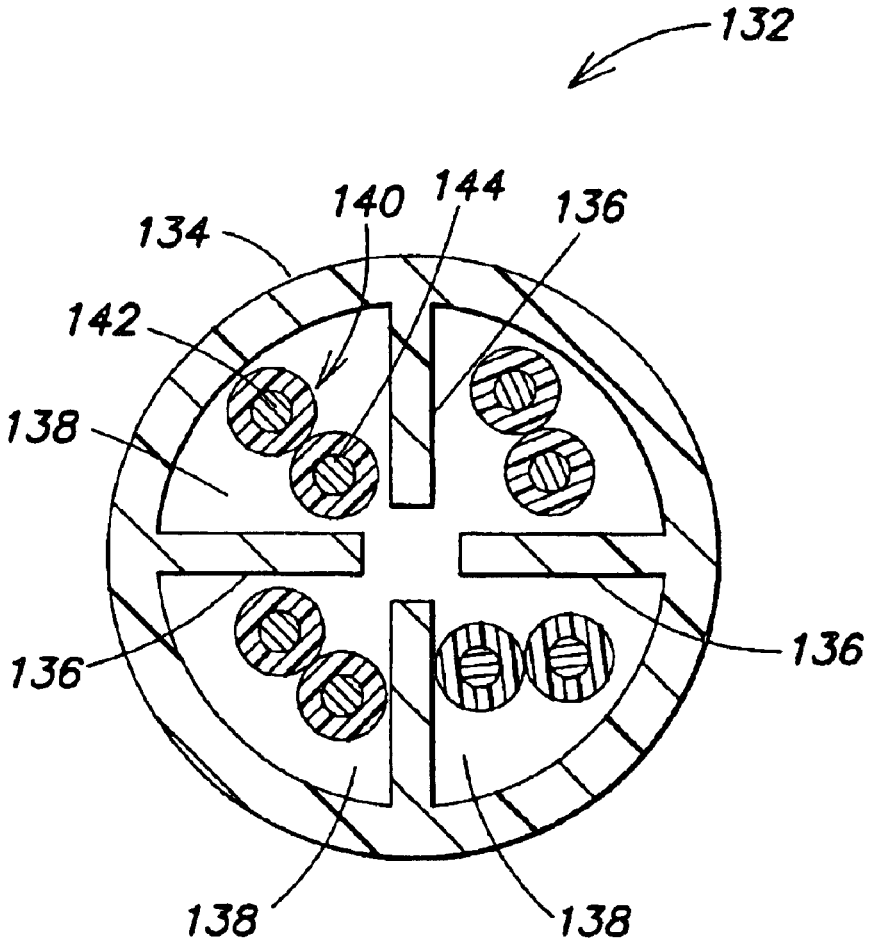
FIG. 3 (RELATED ART)
FIG. 3 is a cross-sectional view of another embodiment of a communications cable according to the related art.
Figure 13:
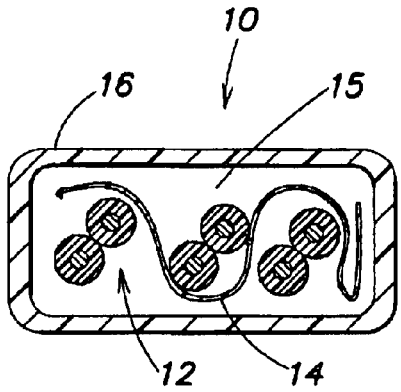
FIG. 13 is a cross-sectional view of a data communications cable according to another embodiment of the invention.

FIG. 13 illustrates yet another embodiment of a data communications cable 10, having a substantially flat configuration. Twisted pairs 12 are encased within a substantially flat jacket assembly 16 and physically separated from each other by the configurable tape separator 14. The cable of FIG. 13 is an alternative to the cable of the related art as illustrated in FIG. 1, and other known flat cables. It is to be understood, that although this embodiment is illustrated with a single fold of the tape separator material between each twisted pair, that the number of folds can be increased to further adjust the distance between each of the twisted pairs and thereby increase the isolation between each of the twisted pairs. Other variations known to those of skill in the art are also intended to be within the scope of the invention and this embodiment. For example, the tape separator may also be disposed at a bottom of the cable with folds directed upwardly towards the top of the cable, in contrast to at the top of the cable with the folds directed towards the bottom of the cable as illustrated in FIG. 13, or the tape separator may be disposed at both the bottom and top. Furthermore, the cable may be provided with one or more additional configurable tape separators to increase arrangement options, thereby facilitating the reduction of crosstalk between twisted pairs in the cable.

Figure 14:
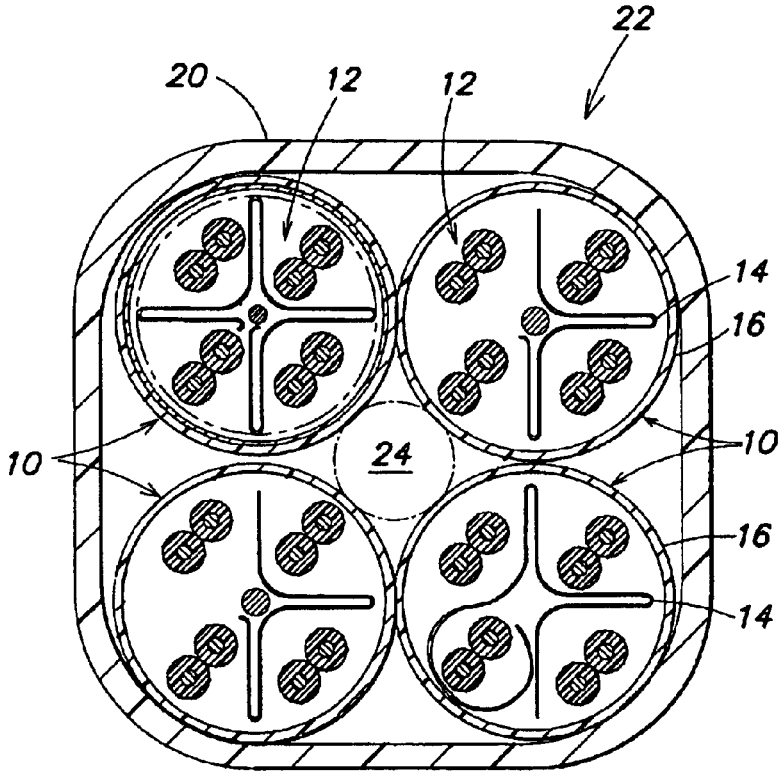
FIG. 14 is a cross-sectional view of a data communications cable according to another embodiment of the invention.
Figure 11:
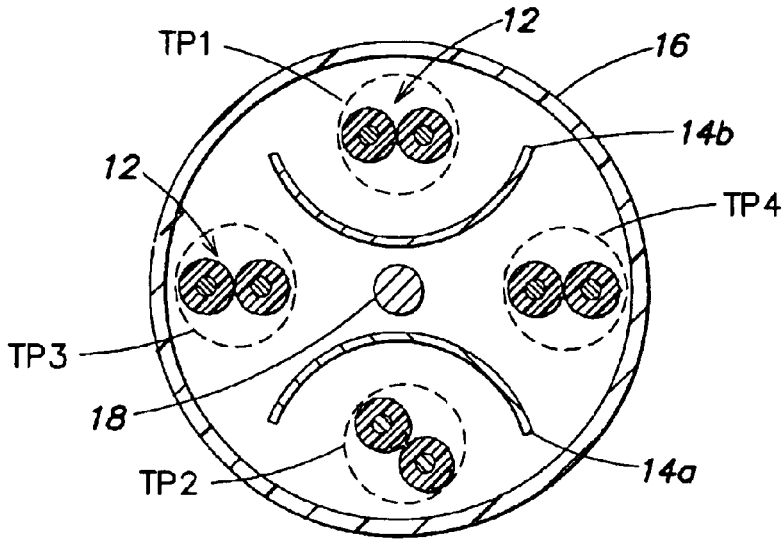
FIG. 11 is a cross-sectional view of a data cable including a plurality of configurable tape separators according to another embodiment of the invention.
Figure 12:
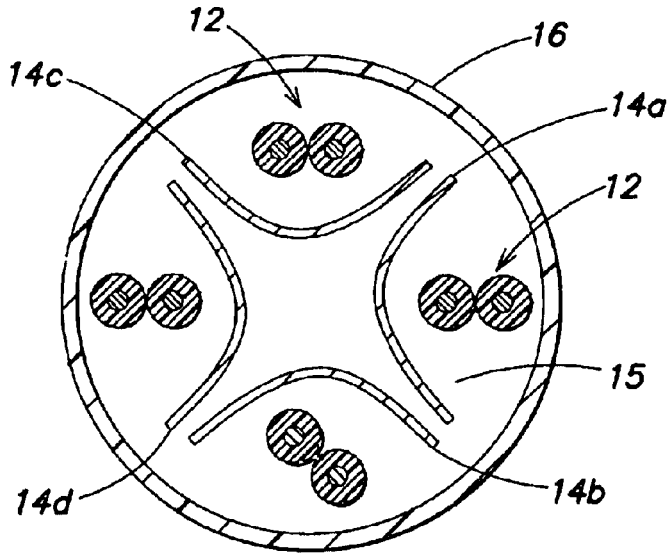
FIG. 12 is a cross-sectional view of a communications cable including a plurality of configurable tape separators according to another embodiment of the invention.

FIG. 14 illustrates an embodiment of a bundled data communications cable 22 including a plurality of data communications cables 10 according to any of the embodiments described above. In particular, each data cable 10 contains multiple twisted pairs 12 separated by one or more configurable tape separators 14 according to any of the above-described configurations, and encased in the jacket assembly 16. The plurality of data cables 10 are enclosed within outer casing 20. The cable 22 may also have a central core filler 24, as illustrated in phantom, that may be formed from any of the above-described materials and may be used to, for example, to keep the data cables in a desired arrangement so as to, for example, minimize crosstalk between each of the data cables 10.

Figure 15:
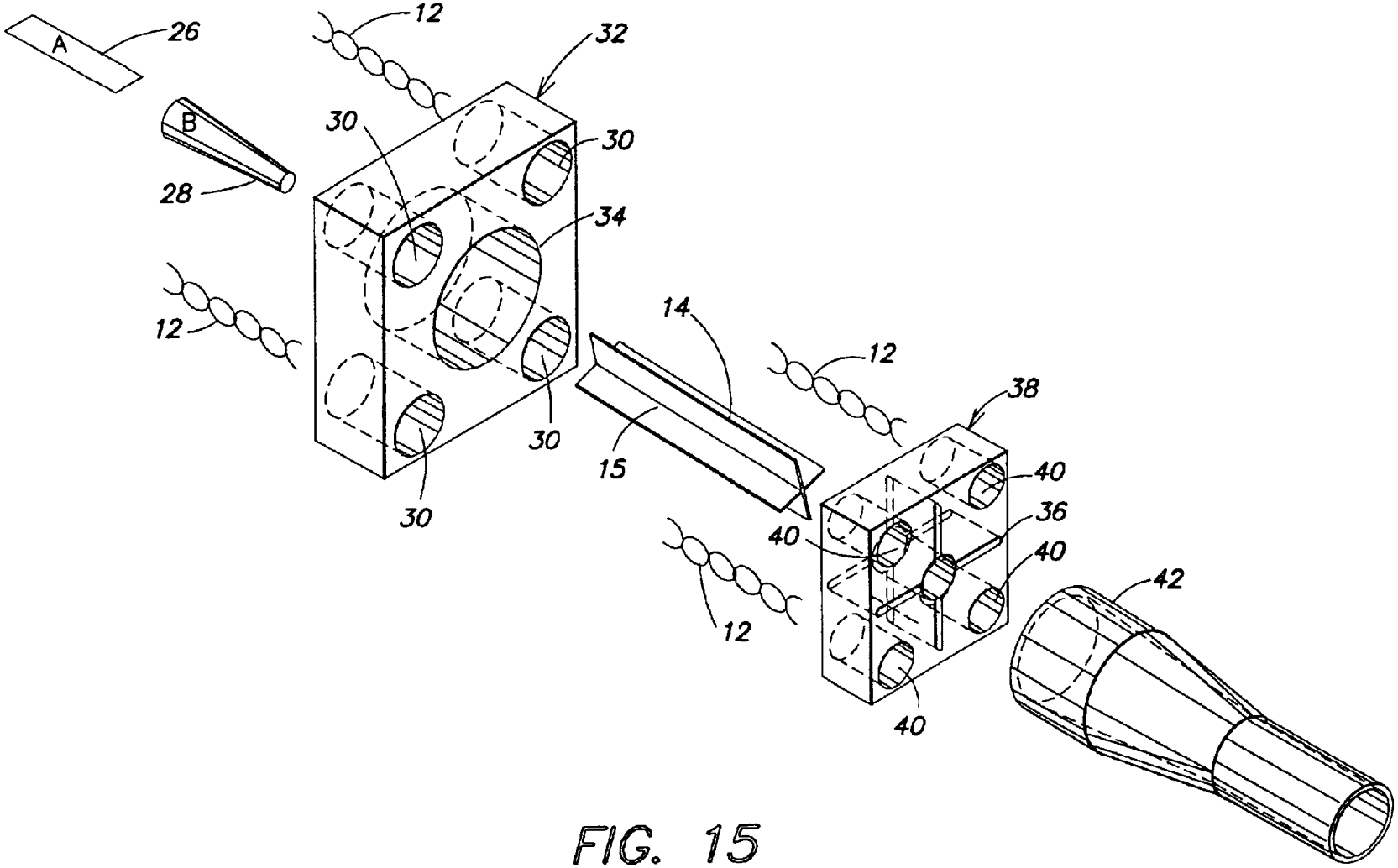
FIG. 15 is a perspective view of a system for practicing a method of making a cable in accordance with an embodiment of the invention.

Referring now to FIG. 15, there is illustrated a perspective view of a system for practicing a method of making a cable in accordance with an embodiment of the invention. The tape separator 26 is drawn from a reel or pad (not shown), and is formed around a round cob 28 into a shaped tape separator such as, for example, in the shape of a cylinder. The shaped tape separator is aligned with four twisted pairs 12 by passing the four twisted pairs through openings 30 in first die 32, and the shaped tape separator through central opening 34. The shaped tape separator is then further configured into a desired shape (formed tape separator) as illustrated in FIG. 15. It is to be appreciated, as discussed above, that this shape can be varied. The formed tape separator 14 is then passed through opening 36 in second die 38 and brought together with the four twisted pairs 12 which are passed through corresponding openings 40 in the second die. The plurality of twisted pairs are then cabled with the formed tape separator by a third die 42, in an operation referred to as "bunching". The third die places the twisted pairs in the channels 15 (see FIGS. 5–12) of the formed tape separator prior to twisting of the cable. It is to be appreciated that the cable can be twisted with any known twisting arrangement such as a helix, or an S-Z configuration. It is also to be appreciated that this method can be varied to include any of the components illustrated and discussed above, such as, for example, to include a drain wire, a binder, a shield, additional tape separators or a central core filler.

Accordingly, some of the advantages of the various embodiments of the data communications cable of the invention are crosstalk performance and isolation enhancement can be configured and provided as customized cable solutions for hardware manufactures who request special requirements. For example, specific twisted pair combinations can receive a dedicated amount of isolation tape folds, thereby enhancing separation of selected twisted pairs and enhancing crosstalk isolation between the selected twisted pairs where an end user, for example, needs more crosstalk isolation. The data communications cable can also be made with a desired crosstalk isolation between the opposing twisted pairs of insulated conductors. In addition, due to the conforming nature and the thickness of the tape separator material, this advantage does not come at the expense of, for example, the size of the data communications cable, and does not result in a reduced impedance stability of the data communications cable. Another advantage is that the amorphous nature of the tape separator yields a desired cable that better facilitates termination of the data communications cable to known industry hardware, than larger diameter cables of the related art.

The present invention has now been described in connection with a number of specific embodiments thereof. However, numerous modifications which are contemplated as falling within the scope of the present invention should now be apparent to those skilled in the art. Therefore, it is intended that the scope of the present invention be defined only by proper construction of the claims appended hereto, and their equivalents.

What is claimed is:

1. A communications cable comprising:

a plurality of twisted pairs of insulated conductors including a first twisted pair of insulated conductors and a second twisted pair of insulated conductors;

a configurable tape separator disposed between the plurality of twisted pairs of insulated conductors and arranged such that the configurable tape separator separates the first twisted pair of insulated conductors from the second twisted pair of insulated conductors without completely surrounding any one twisted pair of the plurality of twisted pairs of insulated conductors; and a jacket enclosing the plurality of twisted pairs of insulated conductors and the configurable tape separator;

wherein the configurable tape separator comprises a dielectric tape, a first at least partially conductive layer disposed on a first side of the dielectric tape, and a second conductive layer disposed on a second side of the dielectric tape.

2. The communications cable as claimed in claim 1, wherein the configurable tape separator is substantially flat.

3. The communications cable as claimed in claim 1, wherein the configurable tape separator and the plurality of twisted pairs of insulated conductors are twisted about a common central axis to form a twisted pair cable.

4. The communications cable as claimed in claim 1, further comprising a conductive shield substantially surrounding the first and second twisted pairs of insulated conductors and the configurable tape separator.

5. The communications cable as claimed in claim 1, wherein the second conductive layer comprises a drain wire.

6. The communications cable as claimed in claim 5, wherein the configurable tape separator further comprises a dielectric layer disposed over the drain wire.

7. The communications cable as claimed in claim 1, wherein the dielectric tape includes a foamed polymer.

8. The communications cable as claimed in claim 1, wherein the dielectric tape includes a woven fiberglass tape.

9. The communications cable as claimed in claim 1, wherein the dielectric tape includes a foamed fluorinated ethylene propylene material.

10. The communications cable as claimed in claim 1, wherein the dielectric tape is a flame-retardant, foamed polymer tape.

11. The communications cable as claimed in claim 1, further comprising an at least partially conductive shield substantially surrounding the plurality of twisted pairs of insulated conductors and the configurable tape separator.

12. The communications cable as claimed in claim 1, wherein the dielectric tape comprises a polyester tape, and the first at least partially conductive layer comprises an aluminum layer.

13. The communications cable as claimed in claim 1, further comprising a central core filling material disposed in a core of the communications cable between the first and second twisted pairs of insulated conductors.

14. The communications cable as claimed in claim 13, wherein the central core filling is made of a same material as the dielectric tape.

15. The communications cable as claimed in claim 1, wherein the configurable tape separator is arranged within the jacket to provide at least two channels, the first twisted pair of insulated conductors being disposed within a first of the at least two channels and the second twisted pair of insulated conductors being disposed within a second of the at least two channels, such that the first and second twisted pairs of insulated conductors are separated from one another by the configurable tape separator.

16. The communications cable as claimed in claim 1, wherein the configurable tape separator is arranged so as to separate each twisted pair of insulated conductors from every other twisted pair of insulated conductors.

17. The communications cable as claimed in claim 1, wherein the configurable tape separator is arranged to provide a sufficient spacing between the first twisted pair of insulated conductors and the second twisted pair of insulated conductors so as to provide a desired crosstalk isolation between the first twisted pair of insulated conductors and the second twisted pair of insulated conductors.

18. The communications cable as claimed in claim 1, further comprising at least one additional configurable tape separator disposed between the plurality of twisted pairs of insulated conductors.

19. The communications cable as claimed in claim 18, wherein the configurable tape separator is arranged with the at least one additional configurable tape separator so as to provide a plurality of channels within the cable, the first twisted pair of insulated conductors being disposed in a first channel and the second twisted pair of insulated conductors being disposed in a second channel.

20. The communications cable as claimed in claim 1, further comprising a ripcord disposed beneath the jacket.

21. The communications cable as claimed in claim 1, wherein the dielectric tape comprises a polyolefin and wherein the first at least partially conductive layer comprises aluminum.

22. The communications cable as claimed in claim 1, wherein the configurable tape separator further comprises a dielectric layer disposed adjacent the first at least partially conductive layer such that the first at least partially conductive layer is located between the dielectric tape and the dielectric layer.

23. The communications cable as claimed in claim 22, wherein the first at least partially conductive layer is narrower than the dielectric tape and the dielectric layer, and wherein the dielectric layer extends over the first at least partially conductive layer to contact the dielectric tape such that the first at least partially conductive layer is substantially electrically shielded from the cable by the dielectric tape and the dielectric layer.

24. A communications cable comprising:

a plurality of twisted pairs of insulated conductors including a first twisted pair and a second twisted pair;

a plurality of separate configurable tape separators disposed between the plurality of twisted pairs of insulated conductors so as to separate the first twisted pair from the second twisted pair without completely enclosing any of the plurality of twisted pairs of insulated conductors; and a jacket surrounding the plurality of twisted pairs of insulated conductors and the plurality of configurable tape separators.

25. The communications cable as claimed in claim 24, wherein each of the plurality of separate configurable tape separators consists of a dielectric tape.

26. The communications cable as claimed in claim 24, wherein at least two separate configurable tape separators are disposed between the first twisted pair and the second twisted pair, separating the first twisted pair from the second twisted pair.

27. The communications cable as claimed in claim 24, wherein at least two separate configurable tape separators are disposed between any two of the plurality of twisted pairs of insulated conductors.

28. The communications cable as claimed in claim 24, wherein at least one side of one of the plurality of separate configurable tape separators is an exposed dielectric material.

29. The communications cable as claimed in claim 24, wherein at least one of the configurable tape separators comprises a dielectric tape and a semi-conductive layer disposed on a first side of the dielectric tape.

30. The communications cable as claimed in claim 24, wherein at least one of the plurality of the configurable tape separators comprises a dielectric tape and a first conductive layer disposed on a first side of the dielectric tape.

31. The communications cable as claimed in claim 30, wherein the at least one configurable tape separator further comprises a second conductive layer disposed on a second side of the dielectric tape.

32. The communications cable as claimed in claim 30, further comprising a conductive shield substantially enclosing the plurality of twisted pairs of insulated conductors and the plurality of configurable tape separators.

33. The communications cable as claimed in claim 30, wherein the dielectric tape comprises a polyester tape, and the first conductive layer comprises an aluminum layer.

34. The communications cable as claimed in claim 30, wherein the dielectric tape includes a foamed polymer.

35. The communications cable as claimed in claim 30, wherein the dielectric tape includes a woven fiberglass tape.

36. The communications cable as claimed in claim 30, wherein the dielectric tape includes a foamed fluorinated ethylene propylene material.

37. The communications cable as claimed in claim 30, wherein the dielectric tape is a flame-retardant, foamed polymer tape.

38. The communications cable as claimed in claim 24, further comprising a central core filling material disposed in a core of the communications cable between the first and second twisted pairs of insulated conductors and the plurality of configurable tape separators.

39. The communications cable as claimed in claim 24, wherein the plurality of configurable tape separators are arranged to provide substantially a "+" shape providing four channels within the cable and wherein the first twisted pair is disposed in a first channel and the second twisted pair is disposed in a second channel.

40. The communications cable as claimed in claim 24, further comprising a ripcord located below the jacket.

41. The communications cable as claimed in claim 24, wherein at least one of the plurality of configurable tape separators is a multi-layer configurable tape separator.

42. The communications cable as claimed in claim 41, wherein the multi-layer configurable tape separator comprises a first at least partially conductive layer, a first dielectric layer disposed adjacent a first side of the first at least partially conductive layer, and a second dielectric layer disposed adjacent a second side of the first at least partially conductive layer.

43. The communications cable as claimed in claim 42, wherein the first and second dielectric layers together substantially surround the first at least partially conductive layer and electrically isolate the first at least partially conductive layer from the cable.

44. The communications cable as claimed in claim 41, wherein the multi-layer configurable tape separator comprises a first at least partially conductive layer, a first dielectric layer disposed adjacent a first side of the first at least partially conductive layer, and a metal drain wire disposed on a second side of the first at least partially conductive layer.

45. The communications cable as claimed in claim 44, wherein the multi-layer configurable tape separator further comprises a pressure-sensitive adhesive layer disposed over the metal drain wire.

46. The communications cable as claimed in claim 44, wherein the first at least partially conductive layer comprises a metal conductor.

47. The communications cable as claimed in claim 44, wherein the first at least partially conductive layer comprises a semi-conductive material.

48. The communications cable as claimed in claim 24, wherein each of the plurality of separate configurable tape separators comprises a dielectric tape and a conductive layer disposed on a first side of the dielectric tape, the plurality of separate configurable tape separators being arranged within the cable such that a second side of the dielectric tape, opposite to the first side, is disposed adjacent the plurality of twisted pairs of insulated conductors.

49. The communications cable as claimed in claim 24, wherein a first one of the plurality of separate configurable tape separators comprises a dielectric tape and a conductive layer disposed on a first side of the dielectric tape and is arranged within the cable so as to provide a channel within which a first one of the plurality of twisted pairs of insulated conductors is disposed, and wherein a second side of the dielectric tape, opposite to the first side, is disposed adjacent the first twisted pair.

50. The communications cable as claimed in claim 24, wherein each of the plurality of separate configurable tape separators comprises a dielectric tape and a conductive layer disposed on a first side of the dielectric tape, the plurality of separate configurable tape separators being arranged within the cable such that the conductive layer is disposed adjacent the plurality of twisted pairs of insulated conductors.

51. The communications cable as claimed in claim 24, wherein a first one of the plurality of separate configurable tape separators comprises a dielectric tape and a conductive layer disposed on a first side of the dielectric tape and is arranged within the cable so as to provide a channel within which a first one of the plurality of twisted pairs of insulated conductors is disposed, and wherein the conductive layer is disposed adjacent the first twisted pair.

* * * * *

UNITED STATES PATENT AND TRADEMARK OFFICE

CERTIFICATE OF CORRECTION

PATENT NO. : 6,812,408 B2
DATED : November 2, 2004
INVENTOR(S) : William Clark et al.

It is certified that error appears in the above-identified patent and that said Letters Patent is hereby corrected as shown below:

Title page,
Item [73], Assignee, delete "Washington, MA (US)" and insert -- Leominster, MA (US) --

Signed and Sealed this

Twenty-sixth Day of April, 2005

JON W. DUDAS
*Director of the United States Patent and Trademark Office*